US008939715B2

(12) United States Patent
Miller

(10) Patent No.: US 8,939,715 B2
(45) Date of Patent: Jan. 27, 2015

(54) ACTIVE TIP CLEARANCE CONTROL FOR SHROUDED GAS TURBINE BLADES AND RELATED METHOD

(75) Inventor: Harold Edward Miller, Glenville, NY (US)

(73) Assignee: General Electric Company, Schenectady, NY (US)

( * ) Notice: Subject to any disclaimer, the term of this patent is extended or adjusted under 35 U.S.C. 154(b) by 958 days.

(21) Appl. No.: 12/728,870

(22) Filed: Mar. 22, 2010

(65) Prior Publication Data

US 2011/0229301 A1 Sep. 22, 2011

(51) Int. Cl.
*F01D 5/02* (2006.01)
*F01D 11/22* (2006.01)
*F01D 11/24* (2006.01)

(52) U.S. Cl.
CPC ..... *F01D 11/22* (2013.01); *F01D 11/24* (2013.01)
USPC ..... 415/131; 415/173.2; 415/173.6; 415/174.1

(58) Field of Classification Search
CPC ..... F01D 5/20; F01D 5/143; F01D 11/14; F01D 11/20; F01D 11/21; F01D 7/00
USPC ..... 415/129, 131, 132, 134, 138, 173.2, 415/173.1, 173.6, 174.1
See application file for complete search history.

(56) References Cited

U.S. PATENT DOCUMENTS 1,823,310 A * 9/1931 Allen ..... 415/48
3,314,651 A * 4/1967 Beale ..... 415/173.6
4,893,983 A 1/1990 McGreehan
5,056,986 A 10/1991 Silvestri, Jr. et al.
5,156,525 A * 10/1992 Ciokajlo ..... 415/199.5
5,203,673 A 4/1993 Evans
5,212,940 A 5/1993 Glover
5,263,816 A 11/1993 Weimer et al.
6,082,963 A 7/2000 Sexton et al.
6,435,823 B1 8/2002 Schroder (Continued)

FOREIGN PATENT DOCUMENTS

EP 1329594 1/2002
EP 1600607 11/2005

(Continued)

OTHER PUBLICATIONS

European Search Report cited in EP 11 15 8416 completed Aug. 7, 2014.

*Primary Examiner* — Nathaniel Wiehe
*Assistant Examiner* — Adam W Brown
(74) *Attorney, Agent, or Firm* — Nixon & Vanderhye, P.C.

(57) ABSTRACT

A turbine bucket tip clearance control system includes a rotor assembly having a rotor supporting a plurality of axially spaced wheels, each wheel mounting an annular row of buckets, the annular row of buckets on at least one of the plurality of axially-spaced wheels having a radially outer tip shroud provided with at least one seal tooth. A stator assembly includes a radially inwardly facing, axially-stepped surface, formed with radially inner and outer seal surfaces connected by a shoulder. The stator assembly and rotor assembly are moveable axially relative to each other, enabling selective positioning of the at least one seal tooth radially opposite one of the radially inner and outer seal surfaces to thereby selectively alter a clearance gap between the at least one seal tooth and the radially inward facing axially-stepped surface.

18 Claims, 4 Drawing Sheets

(56) References Cited

U.S. PATENT DOCUMENTS

| | | | | |
|---|---|---|---|---|
| 6,558,114 | B1 | 5/2003 | Tapley et al. | |
| 6,676,372 | B2 | 1/2004 | Scholz et al. | |
| 7,018,165 | B2 | 3/2006 | Milazar | |
| 7,079,957 | B2 | 7/2006 | Finnigan et al. | |
| 7,234,918 | B2 | 6/2007 | Brillert et al. | |
| 7,246,996 | B2 | 7/2007 | Harris | |
| 7,255,531 | B2 * | 8/2007 | Ingistov | 415/173.1 |
| 7,575,409 | B2 | 8/2009 | Dierksmeier et al. | |
| 7,625,169 | B2 | 12/2009 | Manzoori | |
| 2002/0150469 | A1 | 10/2002 | Bolms | |
| 2008/0063513 | A1 * | 3/2008 | Afanasiev | 415/138 |
| 2008/0131270 | A1 | 6/2008 | Paprotna et al. | |
| 2008/0232949 | A1 | 9/2008 | Reichert et al. | |

FOREIGN PATENT DOCUMENTS

| | | |
|---|---|---|
| EP | 1900907 | 3/2008 |
| GB | 1008526 | 10/1965 |
| GB | 2374123 | 10/2002 |
| JP | 2002349210 | 12/2002 |

* cited by examiner

ACTIVE TIP CLEARANCE CONTROL FOR SHROUDED GAS TURBINE BLADES AND RELATED METHOD

BACKGROUND OF THE INVENTION

This invention relates to turbine seal technology, and more specifically, to active tip clearance control for shrouded gas turbine blades or buckets.

In the later stages of a gas turbine engine, it is common to provide a radially outer tip shroud connecting the tips of the blades or buckets in an annular row of such blades or buckets that are secured to axially spaced turbine wheels fixed to the turbine rotor. The top or radially outer edge of the shroud may be provided with one or more radially-projecting teeth to stiffen the shroud and to act as a labyrinth seal to reduce leakage of the working fluid over the shrouded buckets.

A clearance is necessary between the shroud tooth (or teeth) and the surrounding stator structure to prevent a rub during transient conditions (such as at start-up and shut-down or other significant load changes), but that clearance is to be reduced during normal operating conditions so as to minimize the leakage.

Sometimes the stator structure carries a honeycomb or other abradable surface which tolerates repeated rubs so a tighter clearance can be maintained. It is also known to use multiple teeth, some of which are carried on the tip shroud and others on the opposed stator surface. It is also known to move the stator surfaces radially inwardly to reduce the clearance once the turbine components have reached thermal equilibrium, while keeping large, safe clearances during starting and stopping.

There is also a clearance control system that involves shifting the rotor axially relative to the stator to adjust the gap between respective angled surfaces of shroudless buckets and similarly angled surfaces of the stator.

BRIEF DESCRIPTION OF THE INVENTION

In accordance with one exemplary but nonlimiting aspect of this invention, there is provided a turbine bucket tip clearance control system comprising a rotor assembly including a rotor having a plurality of axially spaced wheels, each of the axially-spaced wheels mounting an annular row of buckets, the annular row of buckets on at least one of the plurality of axially-spaced wheels having a radially outer tip shroud provided with at least one seal tooth; a stator assembly including a radially inwardly facing, axially-stepped surface, the axially-stepped surface formed with radially inner and outer seal surfaces connected by a shoulder; and wherein the stator assembly and the rotor assembly are shiftable axially relative to each other, enabling selective shifting of the at least one seal tooth to a location radially opposite one of the radially inner and outer seal surfaces to thereby selectively alter a clearance gap between the at least one seal tooth and the radially inward facing axially-stepped surface.

In accordance with another exemplary but nonlimiting aspect, the invention provides a turbine bucket tip clearance control system comprising a rotor assembly including a rotor having a plurality of axially spaced wheels, each of the axially-spaced wheels mounting an annular row of buckets, the annular row of buckets on at least one of the plurality of axially-spaced wheels having a radially outer tip shroud provided with at least one seal tooth; a stator assembly surrounding the tip shroud and formed with radially inwardly facing seal surfaces including at least one axially-oriented surface substantially parallel with the rotor axis and at least one contiguous acutely angled surface, wherein the at least one axially-oriented surface defines a maximum clearance gap and the at least one contiguous acutely angled surface defines a range of clearance gaps less than the maximum clearance gap.

In still another exemplary but nonlimiting aspect, the invention provides a method of controlling tip clearances between a tip shroud on an annular row of turbine buckets mounted on a turbine rotor and substantially concentrically arranged turbine stator, wherein the tip shroud is provided with at least one radially outwardly projecting seal tooth, and wherein the stator includes a radially inwardly facing surface including at least first and second seal surfaces defining at least first and second seal clearances, respectively, with a seal edge of the at least one radially outwardly projecting seal tooth, the method comprising: shifting one of the turbine rotor and the turbine stator axially to cause said at least one radially outwardly projecting seal tooth to radially align with the first seal surface during transient start-up and shut-down operations of the turbine; and shifting one of the turbine rotor and the stator axially to cause the radially outwardly projecting seal tooth to radially align with the second seal portion when the turbine is operating at substantial thermal equilibrium.

The invention will now be described in detail in connection with the drawings identified below.

DETAILED DESCRIPTION OF THE INVENTION

Figure 1:
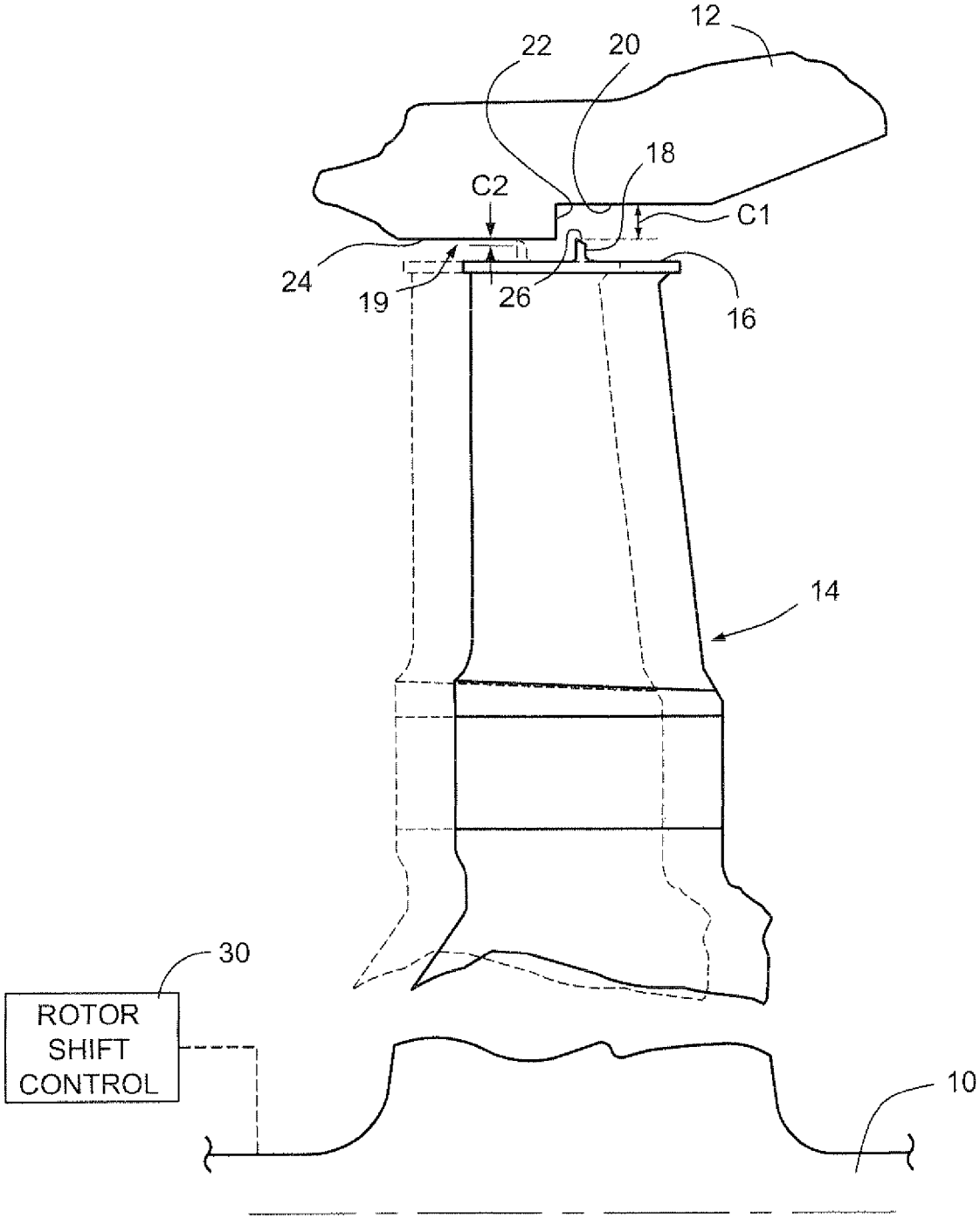
FIG. 1 is a side elevation, partly sectioned, showing a bucket tip clearance configuration in accordance with a first exemplary embodiment of the invention.

With reference to FIG. 1, the gas turbine rotor 10 is located concentrically within a turbine housing portion defined in part by a surrounding stator 12. The rotor 10 is typically formed with a plurality of axially-spaced wheels, each mounting an annular row of blades or buckets (one shown at 14) that extend radially outwardly toward the stator 12, substantially perpendicular to the axis of rotation of the rotor (or simply, "rotor axis"). The buckets 14 in a row of similar buckets on at least on of the wheels are provided with a tip shroud 16 which may be in the form of two or more arcuate segments, each segment extending circumferentially over two or more of the blades or buckets 14. Each of the tip shroud segments 16 may be formed with one or more radially outwardly extending seal teeth 18 that interact with the opposed surfaces of the stator to minimize the leakage of combustion gas across the gap between the tip shroud segments and the stator. For convenience, reference will be made herein simply to the "tip shroud", recognizing that the tip shroud may be constructed of two or more segments as described above.

In one exemplary but nonlimiting embodiment, the radially inwardly facing surface 19 of the stator 12 includes a first axial surface 20, a radial shoulder 22, and a second axial surface 24. In this embodiment, the radial shoulder 22 is oriented substantially 90 degrees relative to the first and second axial surfaces 20, 24. It will be appreciated that the axial surfaces 20 and 24 establish differential radial gaps between the tip shroud and the stator, and more specifically, between the tip of the seal tooth (or teeth) and the stator. In this exemplary embodiment, the rotor 10 and the row of buckets or blades 14 may be shifted axially (to the left) as shown in phantom in FIG. 1. By incorporating the stepped surfaces 20 and 24 on the stator, the seal tooth or teeth 18 can move from an axial position within the large clearance gap portion C1 during transient conditions such as start-up and shut-down, or upon significant load changes, and move to the reduced, tighter clearance gap portion C2 when the turbine components reach (or return to) substantial thermal equilibrium.

Axial shifting of the rotor relative to all or part of a stationary stator may be achieved by any suitable mechanical (or electromechanical), hydraulic or pneumatic means 30 or 130, or by engineered differential thermal expansion properties of the selected rotor and stator materials, as would be understood by the ordinarily skilled worker in the art.

Figure 2:
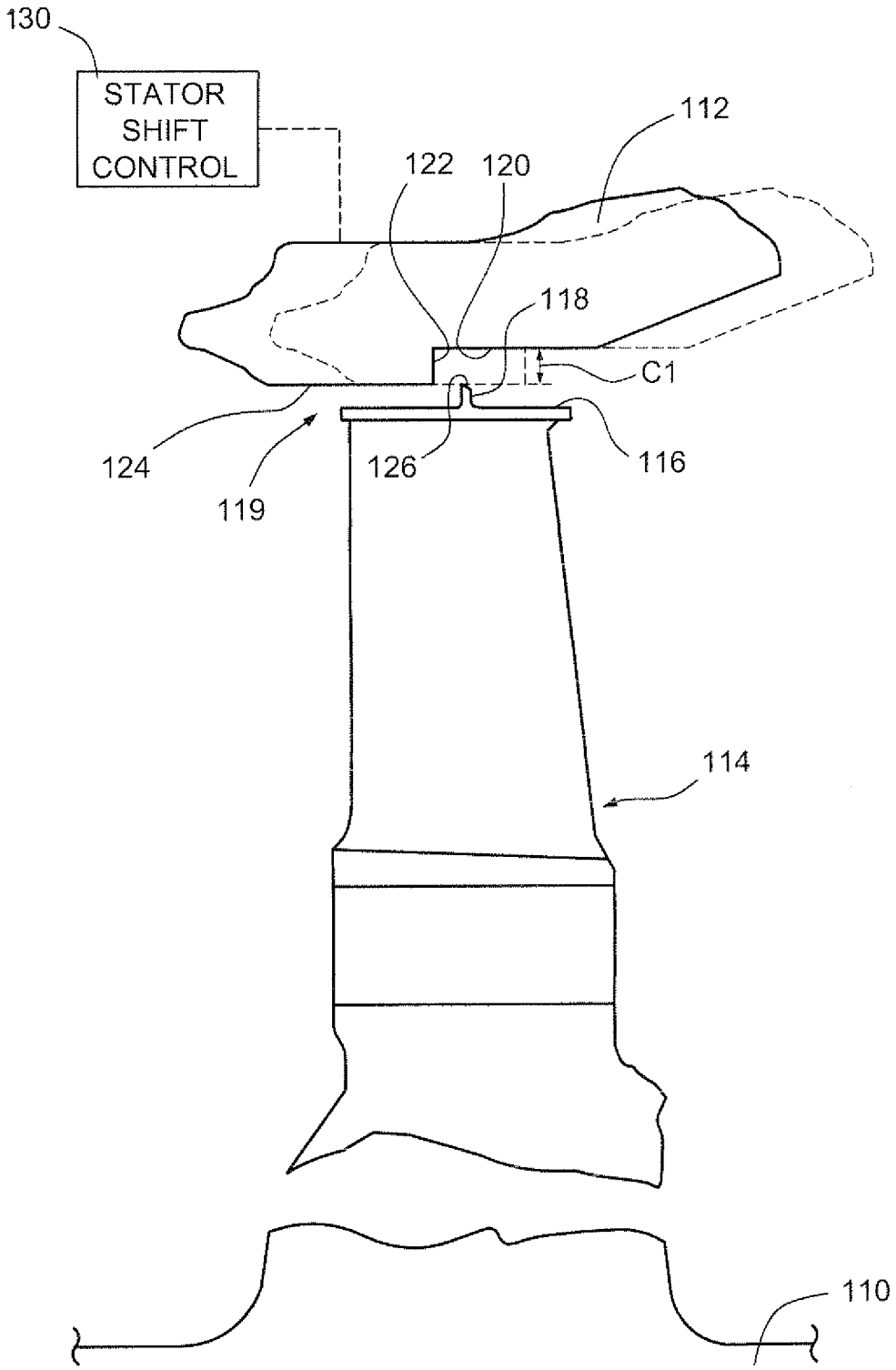
FIG. 2 is a side elevation similar to FIG. 1 but showing an alternative exemplary embodiment.

FIG. 2 represents an alternative exemplary embodiment of the invention. In FIG. 2, similar reference numerals are used to indicate corresponding components but with the prefix "1" added. Here, the rotor 110 remains stationary but the stator 112 can be shifted axially relative to the bucket tip shroud 116 and its seal tooth or teeth 118, to achieve the same result as described above in connection with FIG. 1. It will be appreciated that the outer sealing edge of the seal tooth may be substantially blunt and substantially parallel to the rotor axis (see edge 226 in FIG. 3), or formed to extend at an acute angle to the shroud tip (and to the rotor axis) as shown, for example, at 26 and 126 in FIGS. 1 and 2, respectively.

Figure 3:
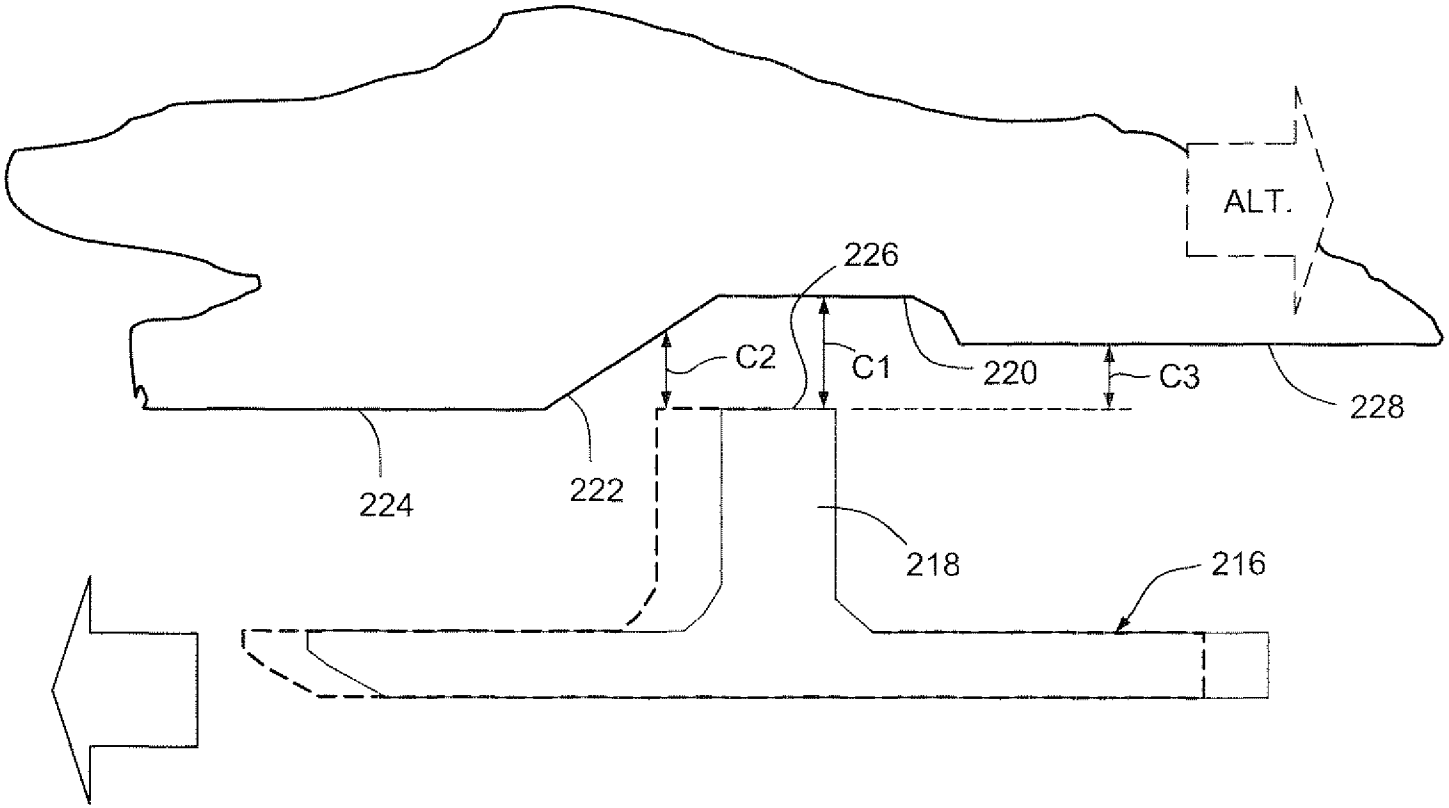
FIG. 3 is a simplified partial side section showing another exemplary embodiment of the invention.

FIG. 3 represents another exemplary but nonlimiting embodiment of the invention. Reference numerals similar to those used in FIGS. 1 and 2, but with the prefix "2" added, are used in FIG. 3 to designate corresponding components. In this exemplary embodiment, the shoulder 222 connecting the axial surfaces 220 and 224 is sloped at an acute angle (for example, 45 degrees) relative to the surfaces 220, 224 and to the rotor axis. This arrangement provides a greater range of gap adjustability between the maximum and minimum clearances between the flat edge 226 of seal tooth 218 and the stator as the rotor is shifted axially relative to the stator (or vice versa). In the example shown, a relative axial shift of 0.50 inch (to the left as shown in FIG. 3) is required to move between a first large clearance gap of C1 and a second smaller clearance gap C2. The exact clearance gaps, required axial shift distance, etc. will vary depending on specific applications.

Figure 4:
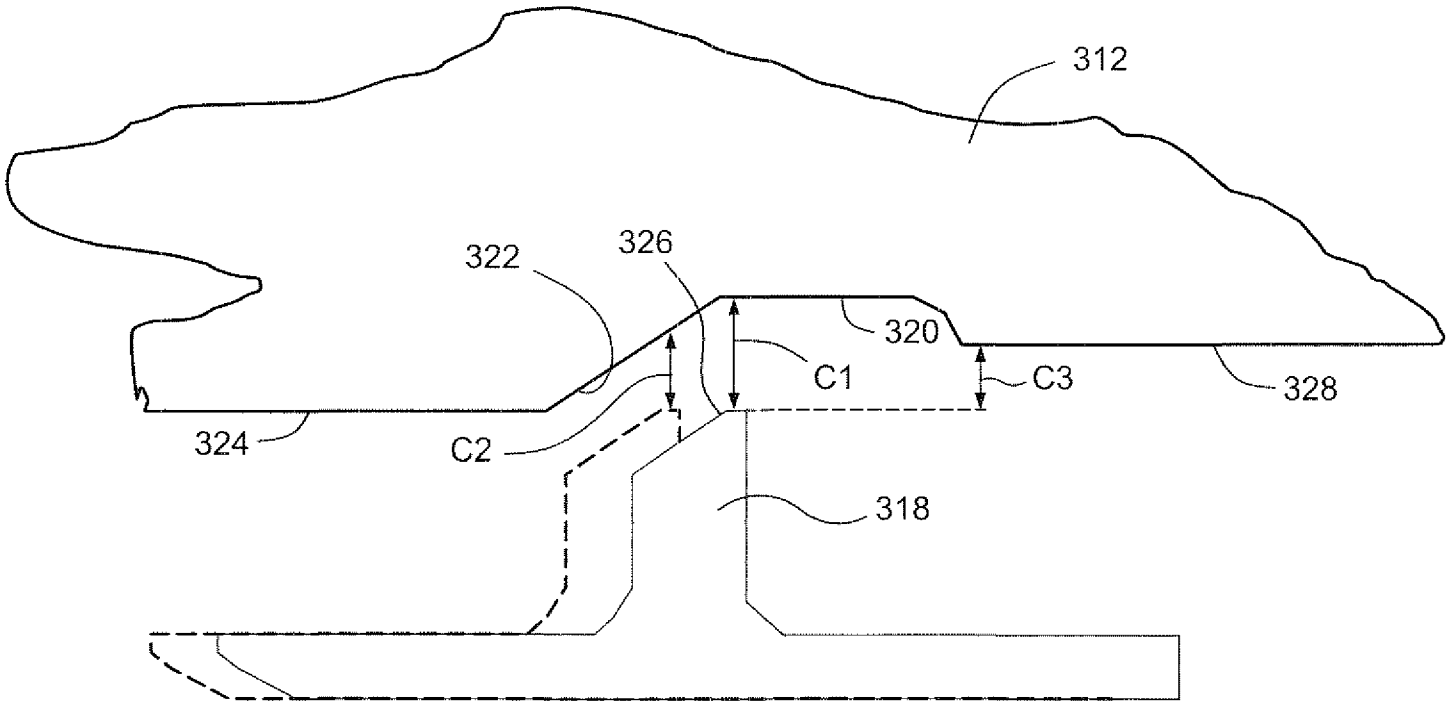
FIG. 4 is a simplified partial side section showing another exemplary embodiment of the invention.

FIG. 4 represents a variation of FIG. 3 and similar reference numerals but with the prefix "3", are used to indicate corresponding components. Here, the seal edge 326 of the seal tooth 318 is formed at a 45 degree angle to the tip shroud (and to the rotor axis) so as to be substantially parallel with the sloped shoulder 322 of the stator 312. Note that for otherwise similar dimensional relationships, the angled seal edge 326 will produce the same clearance gap upon the same 0.50 inch axial shift as described above in connection with FIG. 3.

For the seal configurations in both FIGS. 3 and 4, the stator surfaces 228 and 328 to the right of the surfaces 220, 230, respectively, may provide for an intermediate clearance gap C3 (also achievable along the sloped shoulder 222, 322) in the event relative axial shifting of the rotor or stator in an opposite direction is permitted.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A turbine bucket tip clearance control system comprising:

a rotor assembly including a rotor having a plurality of axially spaced wheels, each of said axially-spaced wheels mounting an annular row of buckets, said annular row of buckets on at least one of said plurality of axially-spaced wheels having a radially outer tip shroud provided with at least one seal tooth;

a stator assembly including a radially inwardly facing, axially-stepped surface arranged to be opposite the radial tip shroud provided on the at least one annular row of buckets, said axially-stepped surface comprising a first horizontal seal surface at a first distance from the tip shroud and a second horizontal seal surface at a second distance from the tip shroud, the first horizontal seal surface and the second horizontal seal surface are connected by a shoulder, the second distance is greater than the first distance; and the first horizontal seal surface and the second horizontal seal surface establish two different seal clearance gaps with said at least one seal tooth; and wherein said stator assembly and said rotor assembly are mechanically shiftable axially relative to each other, enabling selective shifting of said at least one seal tooth to a location radially opposite the first horizontal seal surface or the second horizontal seal surface to thereby enable selectively choosing of one or the other of said two different clearance gaps.

2. The turbine bucket tip clearance control system of claim 1 including a shifting mechanism configured to shift said rotor assembly axially relative to said stator assembly.

3. The turbine bucket tip clearance control system of claim 1 wherein said radially outer tip shroud is provided with at least two seal teeth.

4. The turbine bucket tip clearance control system of claim 1 wherein said at least one seal tooth is formed with an axially-oriented seal edge.

5. The turbine bucket tip clearance control system of claim 1 wherein said at least one seal tooth is formed with an acutely angled seal edge.

6. The turbine bucket tip clearance control system of claim 1 wherein said shoulder is oriented at substantially 90 degrees relative to said radially inner and outer seal surfaces.

7. The turbine bucket tip clearance control system of claim 1 wherein said shoulder is oriented at substantially 45 degrees relative to said radially inner and outer seal surfaces.

8. A turbine bucket tip clearance control system comprising:

a rotor assembly including a rotor having a plurality of axially spaced wheels, each of said axially-spaced wheels mounting an annular row of buckets, said annular row of buckets on at least one of the plurality of axially-spaced wheels having a radially outer tip shroud provided with at least one seal tooth;

a stator assembly comprising a section surrounding said tip shroud and formed with radially inwardly facing seal surfaces including at least one axially-oriented surface substantially parallel with the rotor axis and at least one contiguous acutely angled surface wherein said at least one axially-oriented surface defines a maximum clearance gap and said at least one contiguous acutely angled surface defines a range of clearance gaps less than said maximum clearance gap;

wherein the at least one seal tooth is configured to be moved axially is such a way as to be positioned opposite the section at a location defined between and including the axially-oriented surface provided the maximum clearance gap and any of the clearance gaps defined by the at least one contiguous acutely angled surface.

9. The turbine bucket tip clearance control system of claim 8 wherein said at least one seal tooth is formed with an axially-oriented seal edge.

10. The turbine bucket tip clearance control system of claim 8 wherein said at least one seal tooth is formed with an acutely angled seal edge.

11. The turbine bucket tip clearance control system of claim 8 including means for shifting said rotor assembly axially relative to said stator assembly.

12. The turbine bucket tip clearance control system of claim 8 including means for shifting said stator assembly axially relative to said rotor assembly.

13. The turbine bucket tip clearance control system of claim 8 wherein said tip shroud is provided with at least two seal teeth.

14. A method of controlling tip clearances between a tip shroud on an annular row of turbine buckets mounted on a turbine rotor and a substantially concentrically arranged turbine stator, wherein the tip shroud is provided with at least one radially outwardly projecting seal tooth, and wherein said stator includes a section opposite the tip shroud comprising a radially inwardly facing surface including at least a first horizontal seal surface and a second horizontal seal surface, the first seal surface defining a first distance from the tip shroud and the second seal surface defining a second distance from the tip shroud, the second distance being different than the first distance, the method comprising:

shifting one of said turbine rotor and said turbine stator axially to cause said at least one radially outwardly projecting seal tooth to radially align with said first horizontal seal surface during transient operations of the turbine, the first horizontal seal surface defining a first seal clearance; and shifting one of said turbine rotor and said turbine stator axially to cause said at least one radially outwardly projecting seal tooth to radially align with said second horizontal seal surface when the turbine is operating at substantial thermal equilibrium, the second horizontal seal surface defining a second seal clearance.

15. The method of controlling tip clearances according to claim 14 wherein said turbine rotor is shifted axially relative to said stator.

16. The method of controlling tip clearances according to claim 14 wherein said stator is shifted axially relative to said rotor.

17. The method of claim 14 wherein at least one of said first and second seal surfaces is oriented at an acute angle relative to an axis of rotation of said turbine rotor and wherein a seal edge of said at least one seal tooth is oriented at a substantially identical acute angle.

18. The method of claim 14 wherein at least one of said first and second seal surfaces is oriented at an acute angle relative to an axis of rotation of said turbine rotor and wherein a seal edge of said at least one seal tooth is oriented substantially parallel to said axis of rotation.

* * * * *

UNITED STATES PATENT AND TRADEMARK OFFICE

CERTIFICATE OF CORRECTION

PATENT NO. : 8,939,715 B2
APPLICATION NO. : 12/728870
DATED : January 27, 2015
INVENTOR(S) : Miller It is certified that error appears in the above-identified patent and that said Letters Patent is hereby corrected as shown below:

In the claims:

Claim 8, column 4, line 67, delete "provided" insert --providing--

Signed and Sealed this
Fourteenth Day of July, 2015

Michelle K. Lee

Michelle K. Lee
*Director of the United States Patent and Trademark Office*